United States Patent [19]

Yanagi

[11] 4,385,570

[45] May 31, 1983

[54] PROGRAMMING SYSTEM FOR AUTOMATIC SEWING MACHINE

[75] Inventor: Toshiaki Yanagi, Nagoya, Japan

[73] Assignee: Brother Kogyo Kabushiki Kaisha, Nagoya, Japan

[21] Appl. No.: 222,298

[22] Filed: Jan. 5, 1981

[30] Foreign Application Priority Data

Jan. 31, 1980 [JP] Japan ..... 55-10687

[51] Int. Cl.[3] ..... D05B 21/00

[52] U.S. Cl. ..... 112/121.12; 112/262.1

[58] Field of Search ..... 112/121.12, 121.11, 112/121.15, 102, 103, 158 E, 262.1, 262.3

[56] References Cited

U.S. PATENT DOCUMENTS 4,201,144 5/1980 Manabe et al. ..... 112/121.12

4,290,375 9/1981 Tonomura et al. ..... 112/121.12

4,312,283 1/1982 Fischer et al. ..... 112/121.12

*Primary Examiner*—Peter P. Nerbun

*Attorney, Agent, or Firm*—Browdy & Neimark

[57] ABSTRACT

A programming system for an automatic sewing machine designed to successively form along a desired stitching reference line a specific unit stitch pattern constituted by a plurality of stitches. The programming system includes manual means operative for determining a pattern position of each unit stitch pattern on the reference line, and an arithmetic or processing unit for calculating position data representing the position of each stitch of the unit pattern based on the data representing the determined pattern position. The calculated position data is sequentially stored, as stitch instructions, in a data memory, and the stored position data is retrievable for controlling a sewing operation on the sewing machine. The system further includes a selecting means operative for selecting a desired unit stitch pattern from among a plurality of predetermined different unit stitch patterns thereby allowing an easy programming of the stitch instructions based on a variety of unit stitch patterns.

6 Claims, 9 Drawing Figures

| | IDENTIFICATION No. | REPRESENTATION |
|---|---|---|
| UNIT PATTERN A | 1 | |
| UNIT PATTERN B | 2 | |
| UNIT PATTERN C | 3 | |

PROGRAMMING SYSTEM FOR AUTOMATIC SEWING MACHINE

BACKGROUND OF THE INVENTION

1. Field of the Invention

This invention relates generally to a sewing machine wherein the position of a workpiece relative to a needle is controlled in accordance with stitch instructions which determine the position of two or more successive stitches constituting a specific unit stitch pattern to form a series of such unit stitch patterns on the workpiece along a predetermined reference line, and more particularly to an automatic programming system for automatically working out the stitch instructions for the sewing machine.

2. Description of the Prior Art

There have been developed various sorts of sewing machines capable of forming on a workpiece a complicated seam including a considerable number of stitches. On such sewing machines, stitch instructions specifying or determining each stitch position are extracted sequentially from a data memory to control relative position between the workpiece and the needle and thus the sewing operation may be efficiently performed along a desired line corresponding to the seam. For example, a secondary workpiece may be neatly and accurately sewn on a primary workpiece by successively forming a preselected unit stitch pattern having two or more stitches along the periphery of the secondary workpiece.

Keeping up with the developments of such sewing machines, a variety of automatic programming systems have been developed for automatically preparing stitch instructions necessary for such sewing machines to be able to form successive stitches of a specific unit pattern along a desired stitching line. In those programming systems, the position data representing each stitch position on a desired line (a line corresponding to a seam, constituted by successive stitches) is either worked out for each stitch position manually by a machine operator, or determined by tracing step by step, through a manual operating means, a profile drawn on a record medium as a desired line, and calculating a distance traced in each step from one stitch position to another. For instance, in the U.S. patent of Takao Manabe, U.S. Pat. No. 4,116,143, there is shown a programming system wherein a sewing pattern sheet is provided with marks corresponding to needle lowering positions of a predetermined sewing profile, and the data representing the position of a selected mark is stored in a memory device through operation of a manual operating means by a machine operator when a stylus is positioned on the selected mark. This manual operation will be more cumbersome for the operator and more difficult to perform, and consequently the operator will need more programming time for working out and storing the position data of the marks as the predetermined sewing profile becomes more complicated and the number of the marks is increased. This disadvantage of the system disclosed in the above patent specification means that there are not a few chances for the operator to make programming errors. Thus, the conventionally available programming systems are considerably low in programming efficiency.

BRIEF SUMMARY OF THE INVENTION

Accordingly, it is the primary object of the present invention to provide an automatic programming system capable of efficiently programming, with ease of operation, stitch instructions including at least stitch position data representing each of stitch positions on a complicated seam constituted by a number of stitches.

It is the second object of this invention to provide an automatic programming system capable of determining data representing each of the stitch positions by means of arithmetic or calculating operation according to a pre-established position data calculating program.

It is another object of the invention to provide an automatic programming system capable of programming the stitch position data adapted to a desired unit stitch pattern selected from among a plurality of different unit patterns which are prepared for providing variations of the seam constituted by a series of the same unit patterns successively formed thereon.

To attain the above objects, an automatic programming system in accordance with this invention is provided with manual means operative for determining step by step pattern positions of the unit stitch patterns successively formed along a desired reference line, each of the unit patterns being made up of a plurality of stitches, and further provided with an arithmetic or processing unit for calculating data representing the position of each stitch of the unit patterns, based on the determined pattern positions.

In the automatic programming system of this invention, an inscribed contour 14 (shown by a broken line in FIG. 2) to a seam 13 which is constituted by successively formed unit patterns (zigzag stitches, for example), is used as a programming reference line, and pattern position of each unit pattern on the reference line is determined one after another through manipulation of the manual means, and the position data representing the thus determined pattern position of each unit pattern is utilized to calculate the position of each stitch of the unit pattern. Since the data representing the stitch positions is automatically prepared through the arithmetic operation, the programming system according to the invention may obviate the conventional cumbersome programming need of determining all stitch positions on a desired line by manual operation, and as a result make it possible to program the stitch positions more easily and efficiently. Further, the automatic programming system of the invention may handle two or more difficult unit stitch patterns, and may, for this purpose, store in a program memory a corresponding number of position data calculating programs each adapted to a specific unit pattern to prepare data on stitches of that pattern. The calculating programs stored in the program memory may be selected through easy manual or external operation depending upon the particular geometry, application and other inherent factors of the desired end products. Thus, the system hereof is capable of programming the stitch positions in different modes, permitting a variety of stitch patterns to be used as a unit to constitute a desired line.

Other features and advantages of the present invention will be apparent from the following detailed description of the preferred embodiments.

BRIEF DESCRIPTION OF THE DRAWINGS

The invention is illustrated in the accompanying drawings wherein.

DETAILED DESCRIPTION OF THE PREFERRED EMBODIMENTS

Figure 1:
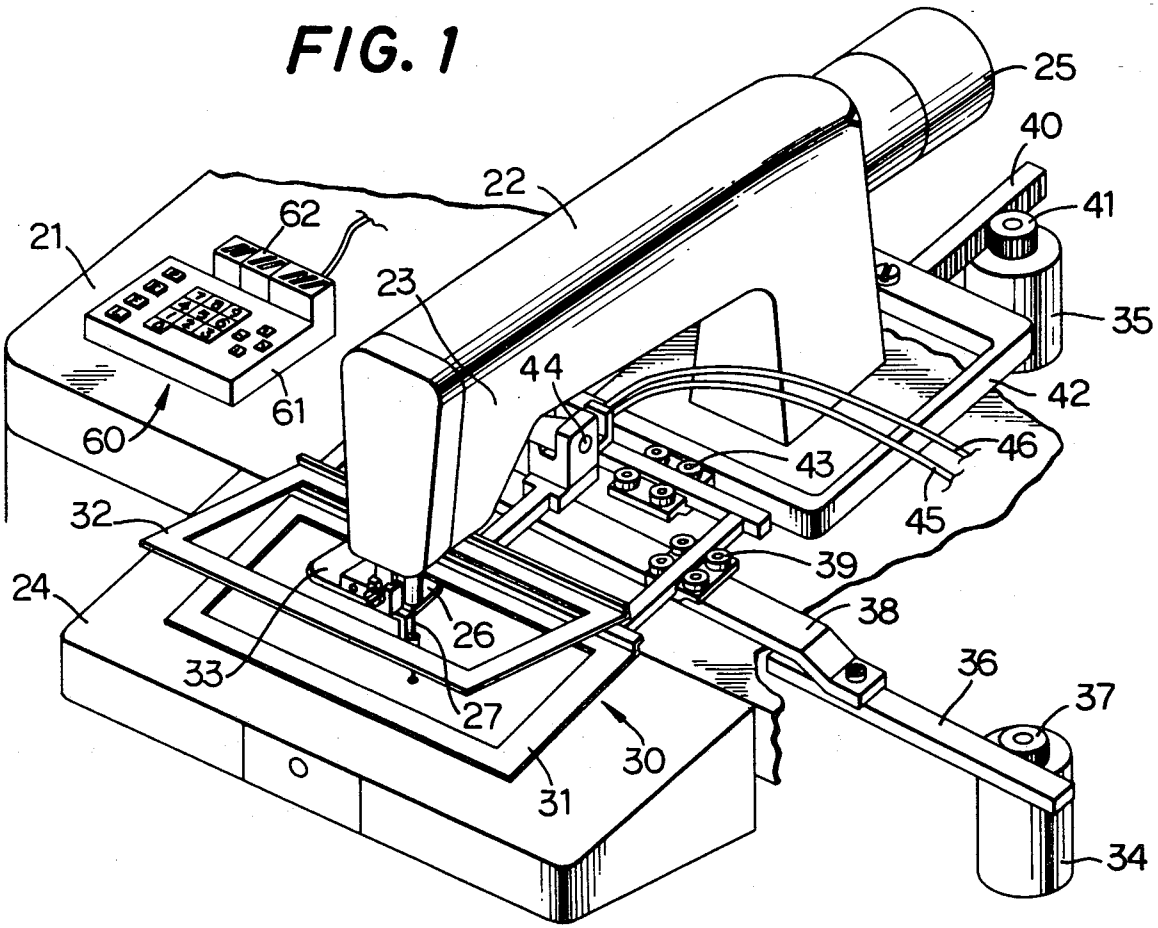
FIG. 1 is a perspective view illustrating an automatic sewing machine which incorporates a preferred embodiment of the automatic programming system of the present invention.
Figure 2:
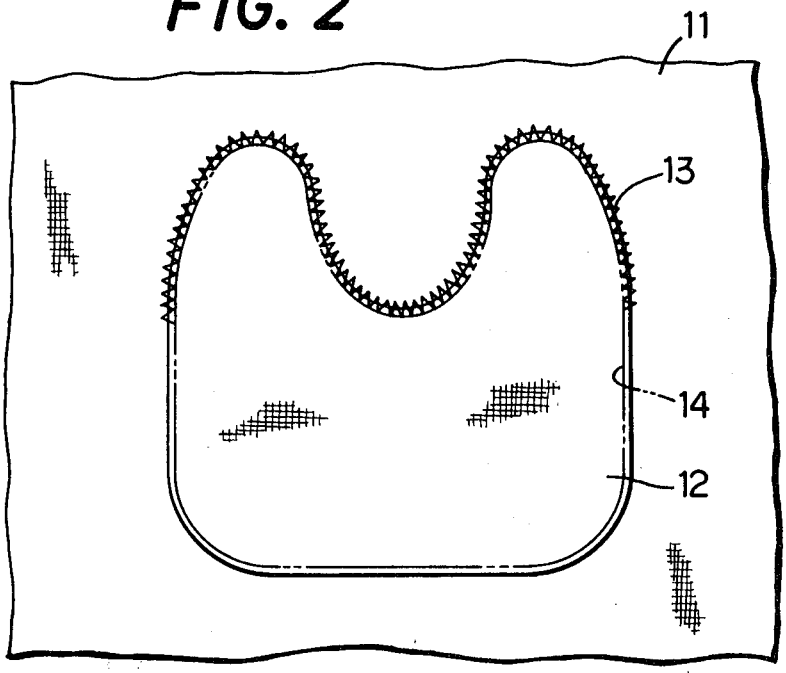
FIG. 2 is a view of a primary and a secondary workpiece, showing a profile along which the latter is sewn on the former.

Referring now to FIG. 1, there is illustrated an essential part of an automatically controlled sewing machine which incorporates an automatic programming system in accordance with the present invention. On a bed 21 of the sewing machine, is mounted a bracket arm 22 whose head 23 is located above a table 24 attached to the front side of the bed 21. The head 23 is equipped with a needle bar 26 which is reciprocated endwise or vertically by means of a main or needle drive motor 25, and a needle 27 is fixed to a lower portion of the needle bar 26. On the machine, a primary workpiece 11 shown in FIG. 2 is held in place between a lower frame 31 and an upper frame 32 of a work holder 30, and a secondary workpiece 12 placed over the primary workpiece 11 is pressed downwardly by an upper clamp 33. A detailed constructional description of the work holder 30 and the upper clamp 33 is omitted herein as they are publicly known as the prior art. While the needle 27 is kept above a surface of the bed 21, both the work holder 30 and the upper clamp 33 are moved relative to the needle 27 along X and Y axes by X and Y pulse motors 34 and 35, respectively. The lower frame 31 is connected to a movable member 38 which is moved along the X axis, i.e., in the longitudinal direction, by the pulse motor 34 through a rack 36 and a pinion 37. On the movable member 38, the frame 31 is slidable along the Y axis, i.e., in the cross direction while being guided by rollers 39 provided on the movable member 38. The lower frame 31 is similarly connected to a movable member 42 which is moved along the Y axis by the pulse motor 33 via a rack 40 and a pinion 41. On the movable member 42, the frame 31 is slidable along the X axis while being guided by rollers 43. Thus, the lower frame 31 is movable on the bed 21 along both X and Y axes in a selected direction by a desired distance according to particular direction and angle of rotation of the feed drive pulse motors 34, 35. On the other hand, the upper frame 32 and the upper clamp 33 are so disposed as to be vertically pivotable about a rotation shaft 44 relative to the lower frame 31 under the control of a known driving device (not shown) which is connected thereto by two flexible cables 45 and 46, thereby allowing the primary and secondary workpieces 11 and 12 to be clamped and unclamped as required.

Figure 3:
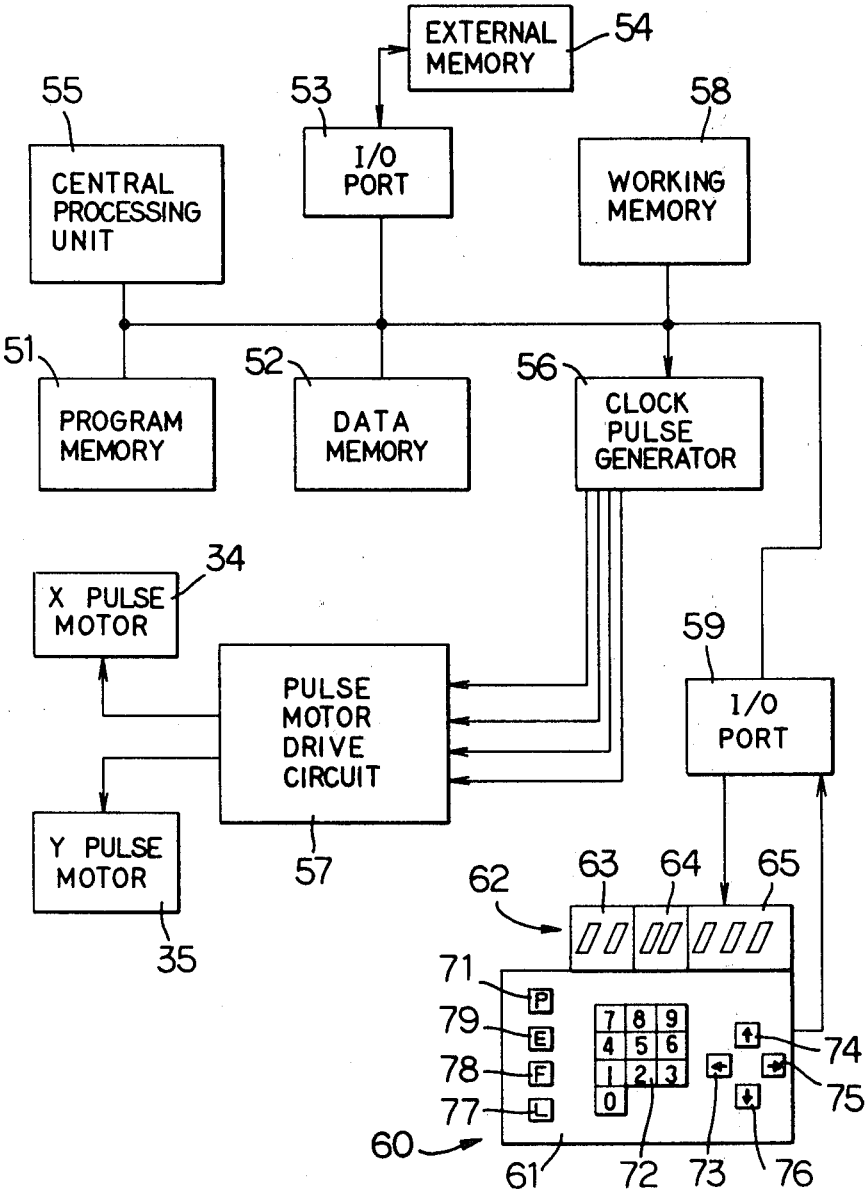
FIG. 3 is a block diagram illustrating an electrical arrangement of the automatic sewing machine.

FIG. 3 is a block diagram illustrating an electrical arrangement or system for use with the automatic sewing machine of this preferred embodiment of the invention, in which a sewing operation of the sewing machine and a programming operation of an automatic programming system built in the machine are controlled in accordance with a sewing control program and a programming control program, respectively, both programs being stored in a program memory 51. Stitch instructions prepared during a programming operation later described are temporarily stored in a data memory 52 before they are permanently stored in a magnetic card or any other proper external memory 54 via an input/output (i/o) port 53. A central processing unit 55 presents a pulse motor control signal to a clock pulse generator 56 according to either one of the sewing and programming control programs stored in the program memory 51, and a pulse motor drive circuit 57, upon reception of clock pulses from the generator 56, commands the X and Y axis pulse motors 34 and 35 to run in a selected number of steps.

An operator's control and indicator device 60 which is provided to enable an operator of the machine to perform a programming operation, consists of a data display unit 62, and an operation control panel unit 61 which contains various control keys including a Program key 71 operative to effect or permit a programming operation. A start switch (not shown) to effect a sewing operation is also provided, but at a separate location. The data display unit 62 comprises X and Y indicators 63 and 64 which optically display respective movements of the X and Y axes actually obtained by operation of the X and Y pulse motors 34, 35, and the unit 62 further comprises an input data indicator 65 which displays data that are entered through Numeral keys 72 contained in the operation control panel unit 61. As long as the programming operation is effective with the Program key 71 set in the ON position, the work holder 30 is movable as desired under the control of the central processing unit 55 by operating four Jog keys 73 through 76 provided on the control panel unit 61. If it is desired to move the work holder 30 in the positive direction along the X or Y axis, for example, it may be achieved by operating the X+ Jog key 73 or Y+ Jog key 74. Likewise, the work holder may be moved in the negative direction along the X or Y axis by operating the X− Jog key 75 or Y− Jog key 76. The operation control panel unit 61 further includes a Load key 77 which is used to temporarily store in a working memory 58 X and Y coordinate values of a programming start position PS pre-selected at a given point on a profile 82 drawn on a plotting paper or other record medium 81, and to store in the said working memory 58 input data entered through the Numeral keys 72. The X and Y coordinate values of the programming start position PS are expressed with respect to a fixed absolute zero point (not shown). Other control keys provided on the control panel unit 61 are a Feed key 78 which permits the work holder 30 to move while the drive motor 25 is at rest, and an End key 79 to produce an end code indicating the end or termination of a programming operation. The input/output port 59 connected to the operator's control and indicator device 60 receives from the control panel unit 61 signals indicating operating conditions thereof, and transfers data display signals to the data display unit 62.

Hereunder is described a programming operation in this preferred embodiment of the invention, the construction of which has been explained above.

Figure 4:
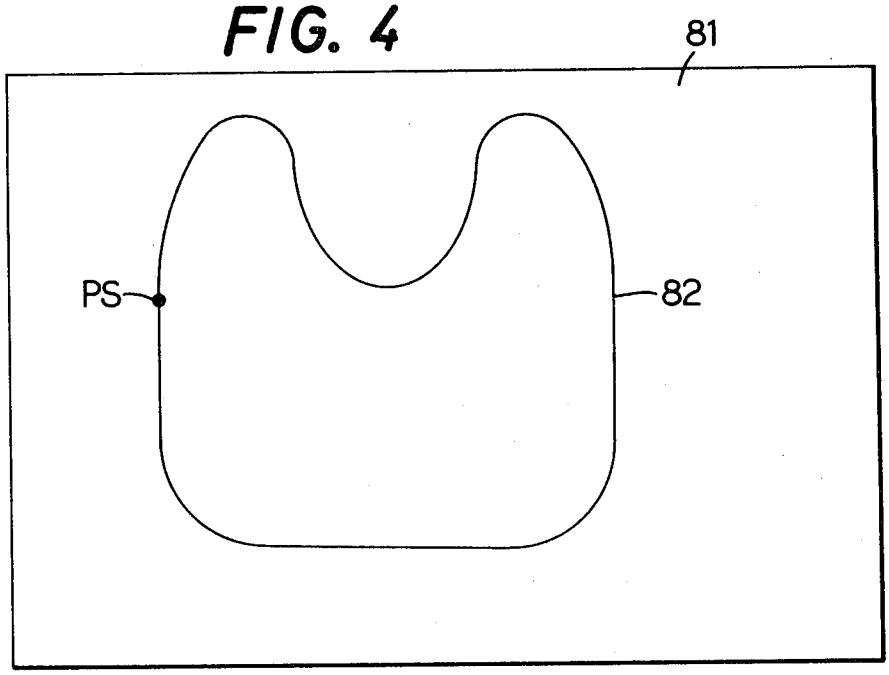
FIG. 4 is a view of a profile drawn on a record medium.
Figures 5, 8:
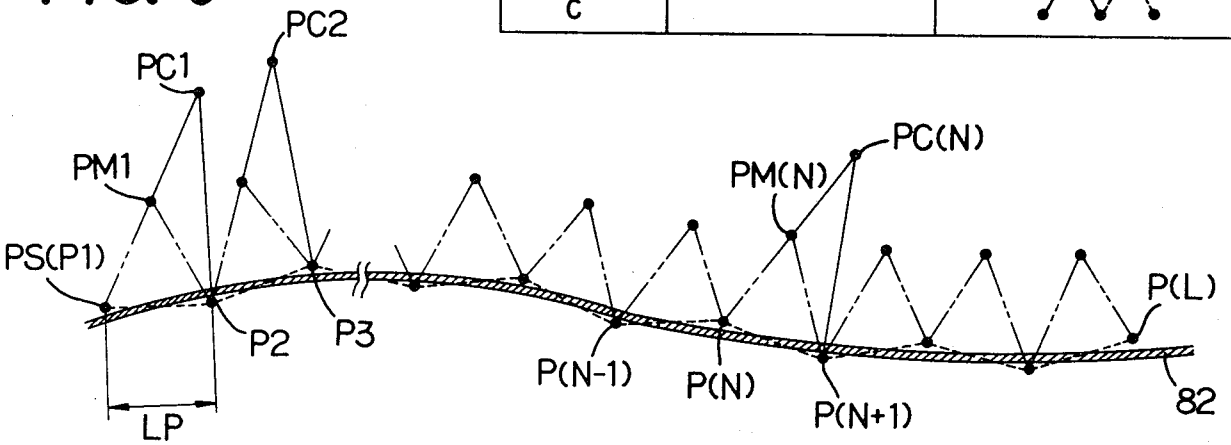
FIG. 5 is a diagrammatic representation of unit stitch patterns.
FIG. 8 is a diagrammatic illustration clarifying an arithmetic operation to be performed in accordance with the position data calculating program.
Figure 6A:
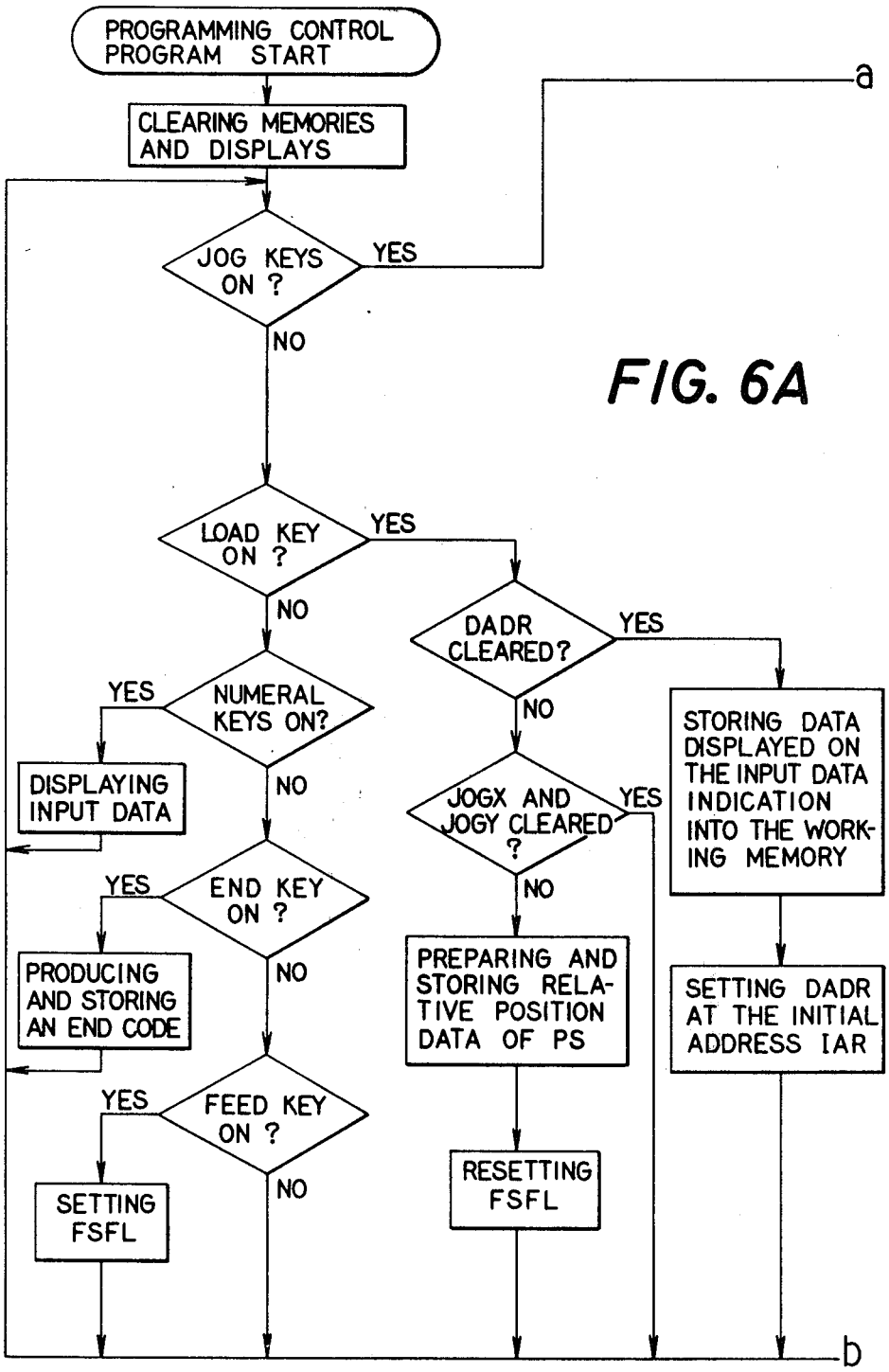
FIGS. 6A and 6B are flow charts showing a programming control program.
Figure 6B:
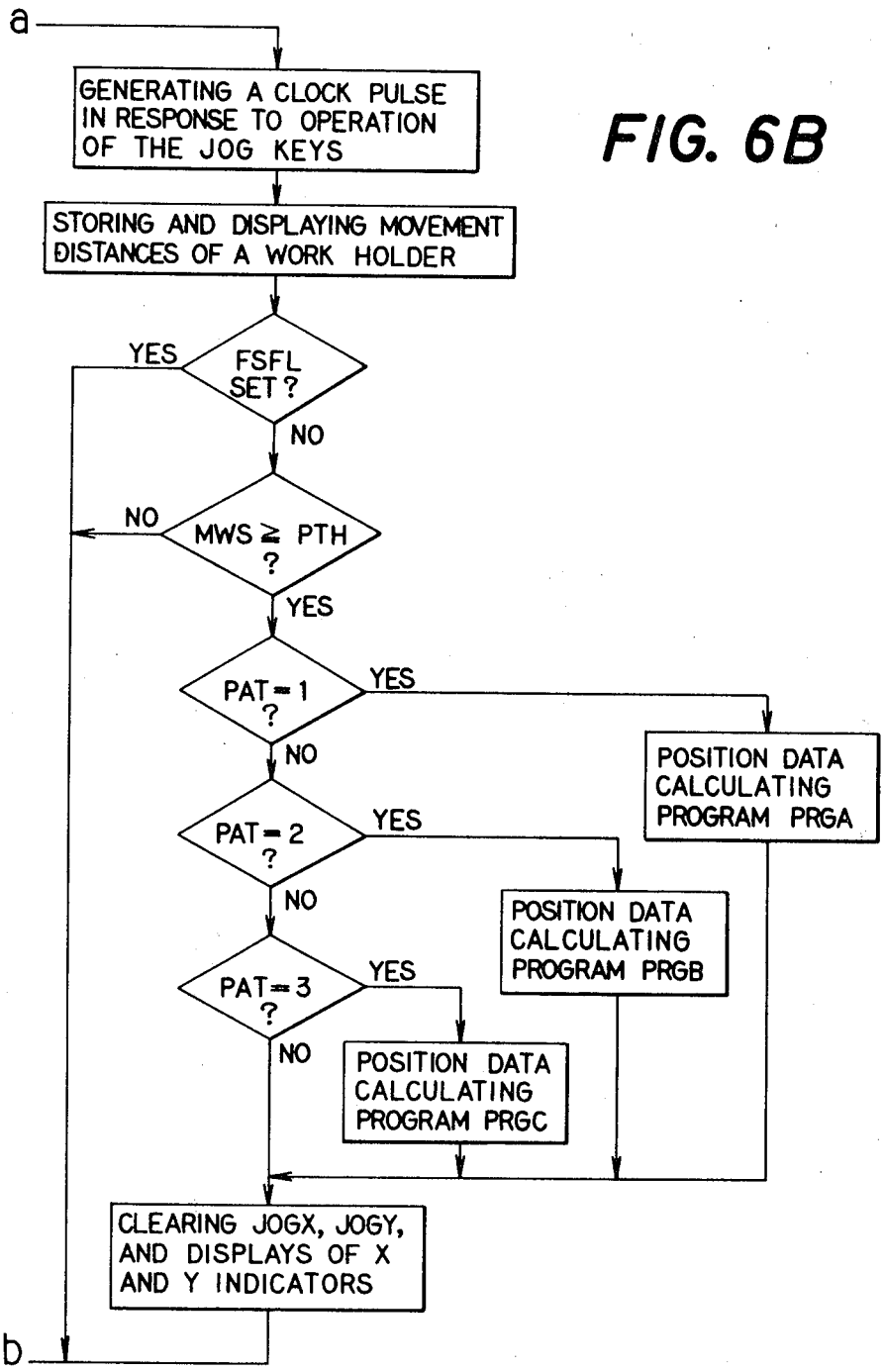

To begin with, a sewing profile 82 is drawn on a record medium 81 as shown in FIG. 4, in conformity with a stitching reference line which, in this specific embodiment, is equivalent to an inscribed contour 14 to a desired line corresponding to a seam 13 shown in FIG. 2, and the record medium 81 is held in the work holder 30. At this time, the upper clamp 33 is removed off the machine and the needle 27 is stopped at its predetermined position above the bed 21. By operating the Program key 71 in this condition, the central processing unit 55 selects a programming control program stored in the program memory 51 and permits starting a programming operation. Thus, the execution of the programming control program illustrated in FIGS. 6A, 6B is initiated, the data memory 52, working memory 58 and data display unit 62 are all cleared, and then the operation status of each of the Jog keys 73 through 76, Load key 77, Numeral key 72, End key 79 and Feed key 78 is sequentially checked. In this embodiment, there are available three different unit stitch patterns A, B and C as shown in FIG. 5, from among which it is possible to select, as a unit pattern to constitute a seam, a desired stitch pattern. If it is desired to select, for example, the unit pattern C which represents a zigzag stitch, then its identification number "3" is required to be entered through the appropriate Numeral key 72. After the numerical data entry to select the unit pattern C is completed, a distance LP (FIG. 8) between two adjacent pattern positions on the reference line (sewing profile 82) and a height of the pattern as measured normal to the reference line are specified by entering corresponding numerical values through the appropriate Numeral keys 72. The unit patterns C are respectively placed at the pattern positions which, in this embodiment, are determined to be first stitch positions of the individual unit patterns C. If the distance LP is 1 mm, for instance, it is equivalent to the movement which is obtained from five clock pulses applied to a pulse motor because the minimum feed increment of the work holder 30, viz., the movement distance per clock pulse to the motor is set at 0.2 mm. The said height of the unit pattern C is represented by its ratio RS to the distance LP, and therefore if the dimension is 1 mm, the ratio RS is "1". Hence, in this particular case, the numerical value "5" is entered to specify the distance LP and "1" to specify the ratio RS of the height to the distance LP, by operating the appropriate Numeral keys 72. Currently, the input data indicator 65 is displaying the identification number "3" of the selected unit pattern C, the numerical value "5" relating to the distance LP, and "1" representing the ratio RS. When the Load key 77 is then operated to store in the working memory 58 the data currently displayed on the input data indicator 65, content DADR of a specified address in the working memory 58 is checked. The programming control program is so designed that the content DADR represents the address which is currently designated in the data memory 52, the present content DADR is "00" as the memory 58 has been previously cleared. Accordingly, with the operation of the Load key 77, the entered identification number "3" of the unit pattern C currently displayed on the input data indicator 65 is stored at the appropriate address in the working memory 58 as the content PAT, the numerical value "5" relating to the distance LP at the appropriate address as the content PTH, and the value "1" representing the ratio RS at the appropriate address as the content LNG. Then, the content DADR is set at the initial address IAR in the data memory 52.

Now, the Feed key 78 is operated to permit a programming operation of the programming or sewing start position PS with respect to the fixed absolute zero point while the drive motor 25 is at rest, and then the work holder 30 is moved by operating the Jog keys 73 through 76 until the start position PS preset on the record medium 81 is located right below the needle 27. The movements of the work holder 30 along the X and Y axes are stored at the appropriate addresses in the working memory 58 as the contents JOGX and JOGY, respectively, and at the same time displayed on the respective X and Y indicators 63 and 64. When the Load key 77 is operated to prepare data on the programming start position PS relative to the absolute zero point, the memory contents DADR, JOGX and JOGY are checked sequentially, the relative position data is prepared based on the JOGX and JOGY and stored at the initial address IAR in the data memory 52 designated by the memory content DADR, and four addresses following the initial address IAR in the data memory are sequentially designated and the memory content DADR is advanced accordingly as the designated address is changed.

Figure 7:
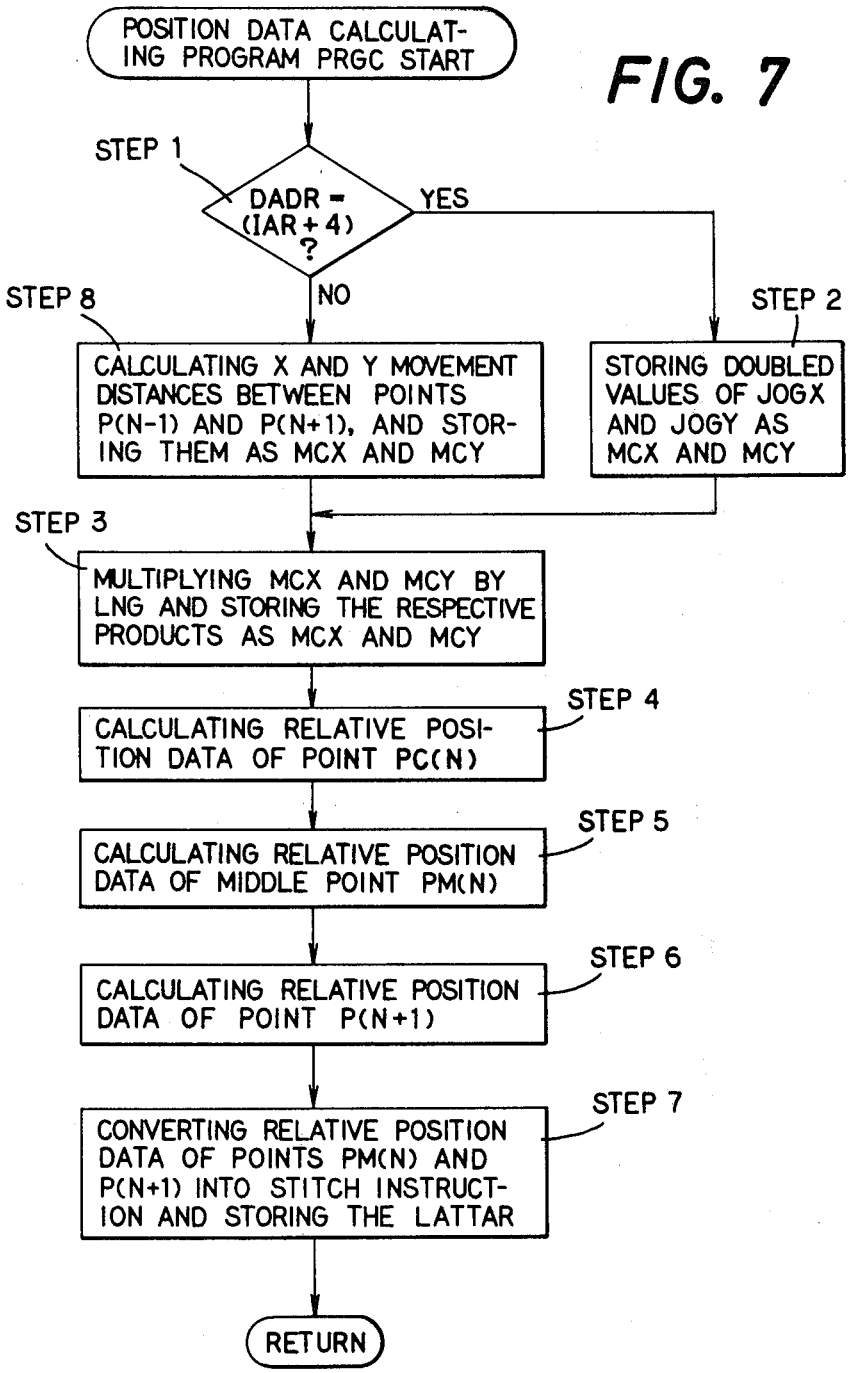
FIG. 7 is a flow chart showing a position data calculating program.

After the data on the programming start position PS has been stored in the above manner, the programming operation is executed by tracing the sewing profile 82 shown in FIG. 4 from the start position PS while operating the Jog keys 73 through 76. When a resultant movement distance MWS of the work holder 30 ($MWS=\sqrt{(JOGX)^2+(JOGY)^2}$) has exceeded a value of the memory content PTH representing the distance LP, a program to calculate data representing a position of each stitch of a given unit pattern is selected. Three stitch position data calculating programs PGRA, PRGB and PRGC are provided corresponding to the available unit patterns A, B and C, respectively. In this specific example, the program PRGC shown in FIG. 7 is selected and executed since the unit pattern C is selected as previously discussed.

The following description explains a calculating or arithmetic operation to be carried out in accordance with the above position data calculating program PRGC.

The position data calculating program PRGC is executed step by step in the sequence as described below when the movement distance of the work holder from the programming start position PS (first stitch position P1 of the first unit pattern) to the first stitch position P2 of the second unit pattern shown in FIG. 8 has become larger than the specified distance LP:

STEP 1: In this step is checked whether or not the memory content DADR has been advanced to the address which is the fourth as counted in the forward direction from the initial address IAR, i.e., (IAR+4). Now, the result of the above check is affirmative (YES).

STEP 2: In this step, the values of the memory contents JOGX and JOGY representing the X and Y movement distances of the work holder 30 are doubled respectively and the doubled values are stored at the appropriate addresses in the working memory 58 as the contents MCX and MCY. At present, the JOGX and JOGY represent the distances travelled from the position PS (position P1) to the position P2 along the X and Y axes, respectively.

STEP 3: In this step, the values of the memory contents MCX and MCY are multiplied by the value of the memory content LNG, and the respective products are stored as the contents MCX and MCY.

STEP 4: In this step, the data of a position PC(N) relative to a position P(N) are calculated from or on the basis of the memory contents JOGX, JOGY, MCX and MCY. (The value "N" must be an integer greater than "1".) Since the value "N" is "1" at present, the data of the relative position of the position PC1 to the position P1 is calculated in this step. The position PC1 is located away from the position P2 by a distance equal to LPC which is twice the distance LP, in the direction normal to a straight line passing the position P1 and P2.

$$LPC = \sqrt{(MCX)^2 + (MCY)^2}$$

STEP 5: In this step, the data of a position PM(N) which is a middle point between the positions P(N) and PC(N), relative to the position P(N) is calculated by dividing the data of the position PC(N) relative to the position P(N) by two.

STEP 6: In this step, the data of a position P(N+1) relative to the middle position PM(N) is calculated from the memory contents JOGX and JOGY, and the relative position data of the PM(N). In this case, the data of the position P2 relative to the position PM(1) is calculated.

STEP 7: In this step, the relative position data of of the middle position PM(N) and the relative position data of the position P(N+1) are converted into a stitch instruction and stored at that address in the data memory 52 which is designated by the memory content DADR. Each time a stitch instruction is stored at a designated address in the memory 52, the content DADR is updated to designate the address in the memory 52 at which the next stitch instruction is to be stored. The stitch instruction in this preferred embodiment of the invention includes drive control data directing the drive motor to start and stop its operation, as well as the above indicated relative position data. In the case where the drive motor is started and stopped by the operator, such relative position data may alone be stored in the data memory 52. The manner of updating or advancing the memory content DADR and preparing the stitch instruction is described in more detail in the Japanese patent application, TOKU-KAI-SHO No. 55-38146 published on Mar. 17, 1980.

Thus, the stitch instructions relating to the positions PM1 and PM2 are prepared, and the next program instruction is executed after termination of the position data calculating program PRGC, whereby the memory contents JOGX and JOGY, and the X and Y indicators 63 and 64 are cleared and the operation status of the control keys is again checked.

By operating the Jog keys 73 through 76, the work holder 30 is moved along the profile 82 from the position P2 which is the first stitch position of the second pattern as shown in FIG. 8, up to the position P3 which is the first stitch position of the third pattern. When the work holder 30 has reached the position P3 and its movement distance exceeded the distance LP, the execution of the position data calculating program PRGC is again started. At first, the STEP 1 is executed. Now, the result of the check is negative (NO) because the memory content DADR was advanced from the address (IAR+4) in the previous execution of the program PRGC, and consequently executed is the STEP 8 which is described below:

STEP 8: In this step, the movement distances of the work holder 30 along the X and Y axes from the position P(N−1) to the position P(N+1) are calculated from the relative position data contained in the two sets of stitch instructions relating to the position PM(N−1) and the other to the position P(N), and from the memory contents JOGX and JOGY representing the X and Y movement distances of the work holder from the position P(N) to the position P(N+1). The results of the calculation are stored as the memory contents MCX and MCY. At present, the memory contents MCX and MCY represent the movement distances along the X and Y axes from the programming start position PS (position P1) to the position P3.

The STEP 8 is followed by the STEP 3 and STEP 4 which are executed in that order. In the STEP 4, this time, the position data of the position PC2 relative to the position P2 is calculated. The point PC2 is located away from the position P3 by a distance equal to the distance between the position P1 and P3 multiplied by the previously indicated ratio RS, in the direction normal to the straight line passing the positions P1 and P3. Subsequently, the STEP 5, STEP 6 and STEP 7 are taken sequentially, whereby the two sets of stitch instructions relating to the middle position PM2 and the position P3 are prepared and stored in memory. Thus, the stitch instructions relating to positions PM(N) and P(N+1) may be automatically prepared one after another by way of repeating the operation of the Jog keys 73 through 76 and the execution of the STEP 1, STEP 8, STEP 3, . . . STEP 7. If the End key 79 is activated after the work holder 30 has reached the position P(L) shown in FIG. 8 and the stitch instruction relating to the position PM(L−1) prepared, an end code indicating the termination of the programming operation is prepared and stored in the data memory 52.

Stitch instructions which are stored in the data memory 52 in such manner as described above, are sequentially extracted and executed during a sewing operation, controlling the action of the work holder drive X and Y pulse motors 34 and 35, and of the main drive motor 25 as well. When the end code is presented, the main drive motor 25 is turned off and the sewing operation is terminated. In the course of the sewing operation according to the stored stitch instructions, a plurality of the unit patterns C are successively formed along the reference line whereby the seam 13 may be obtained as shown in FIG. 1.

In the above described embodiment of this invention, a desired unit stitch pattern is selected and data on the selected pattern (distance LP and ratio RS) is entered into memory prior to programming the desired line corresponding to the seam 13, and the stitch instructions that determine all stitch positions on the desired line 13 may be easily and exactly prepared by tracing the profile 82 during the programming operation. The embodiment also features that the relative position data of the middle position PM(N) is calculated from a distance between the first stitch positions P(N−1) and P(N+1) of the unit pattern whereby the position of all middle position PM(N) except PM1 is always determined under the influence of the first stitch position P(N−1) of the preceding unit pattern. This feature permits the middle positions PM(N) to be shifted smoothly and therefore provides an extremely effective means of obtaining a neatly stitched line on the workpiece.

Although a preferred embodiment of the present invention has been described above with a certain degree of particularity, it is understood that various modifications and variations of an automatic programming system of the invention will occur to those skilled in the art without departing from the scope of the claims. For example, the invention may be embodied in the following forms:

(a) An automatic programming system which comprises; a manual data setting means for manually setting data of each of first stitch positions of the same unit stitch patterns, the first stitch positions being successively marked on a profile drawn on a plotting paper, the data being read by a machine operator from the plotting paper as the relative position data with respect to the preceding first stitch position, and a manual data input means operative for manually entering the previously set relative position data into a processing or arithmetic unit, thereby preparing stitch instructions relating to each stitch of the successive unit patterns by calculation or arithmetic operation based on the relative position data entered in response to each operation of the manual data input means.

In the above automatic programming system, the programming control program may be simple as it is not necessary to move the work holder 30 with use of the Jog keys 73 through 76 as is done in the previous embodiment.

(b) An automatic programming system which comprises; a pointing member or an index member so disposed as to be manually movable in order for a machine operator to visually trace or follow first stitch positions of the same unit stitch patterns, the start positions being successively marked on a profile drawn on a record medium, a detector to detect movements of the index member, and a manual data input means operative for manually entering into a processing or arithmetic unit the movement of the index member as the relative position data of each marked position when the index member is located at each marked first stitch position, thereby preparing stitch instructions by calculation or arithmetic operation in response to each step of operations of the manual data input means.

What is claimed is:

1. A programming system for an automatic sewing machine which varies relative position between a workpiece and a needle to form a series of unit stitch patterns of the same shape along a predetermined reference line, each of said unit stitch patterns consisting of successive stitches, said programming system comprising:

manual means operative to determine pattern positions on said reference line, said unit stitch patterns being respectively placed at said pattern positions;

means for generating pattern position data corresponding to said pattern position;

program storage means for permanently storing a calculation program prearranged to determine different stitch positions in said unit stitch pattern, said different stitch positions including at least one position spaced from said reference line, said successive stitches being respectively placed at said different stitch positions;

processing means for executing said calculation program based on said pattern position data to work out stitch instructions each of which relates to each of said different stitch positions and is capable of influencing said relative position; and instruction storage means for storing the stitch instructions worked out by said processing means with respect to all of said unit stitch patterns to be formed along said reference line.

2. A programming system as set forth in claim 1, wherein said manual means includes switch means for setting at least one parameter representing the characteristic of said unit stitch pattern, and said processing means works out said stitch instructions on the basis of said pattern position data and said at least one parameter set by said switch means.

3. A programming system as set forth in claim 1, wherein said program storage means permanently stores a plurality of programs respectively corresponding to predetermined different unit stitch patterns, and said manual means includes switch means for selecting one program from among said plurality of programs.

4. A programming system as set forth in claim 1, further comprising;

a record medium provided with said reference line, an index member one end thereof being opposed to a surface of said record medium, a driving mechanism responsive to the operation of said manual means for varying the relative position between said record medium and said index member to trace said reference line.

5. A programming system as set forth in claim 4, wherein said manual means includes switch means for setting a distance between said successive pattern positions on said reference line, said generating means calculates a variation in said relative position between said record medium and said index member to generate said pattern position data, and said processing means executes said calculation program when the variation calculated by said generating means is said set distance or more.

6. A method of working out stitch instructions for an automatic sewing machine having a needle, drive means operative to vary relative position between the needle and a workpiece to be sewn, instruction storage means for storing said stitch instructions, and position control means responsive to each of the stored stitch instructions for controlling the operation of said drive means synchronously with reciprocation of the needle to form along a predetermined reference line a series of unit stitch patterns of the same shape each of which consists of successive stitches, said method comprising the steps of:

preparing a calculation program for determining different stitch positions in said unit stitch pattern, said different stitch positions including at least one position spaced from said reference line, said successive stitches being respectively placed at said different stitch positions;

determining pattern positions on said reference line, said unit stitch patterns being respectively placed at said pattern positions;

generating pattern position data corresponding to said pattern position;

executing said calculation program based on said pattern position data to calculate said stitch instructions each of which relates to each of said different stitch positions; and storing said calculated stitch instructions in said instruction storage means with respect to all of said unit stitch patterns to be formed along said reference line.

* * * * *